United States Patent [19]

Darling et al.

[11] Patent Number: 4,569,680

[45] Date of Patent: Feb. 11, 1986

[54] GASIFIER WITH ECONOMIZER GAS EXIT TEMPERATURE CONTROL

[75] Inventors: Scott L. Darling, Tariffville; Paul R. Thibeault, Windsor, both of Conn.

[73] Assignee: Combustion Engineering, Windsor, Conn.

[21] Appl. No.: 686,563

[22] Filed: Dec. 26, 1984

[51] Int. Cl.[4] ..... C10J 3/48; C10J 3/86

[52] U.S. Cl. ..... 48/77; 48/67; 122/5; 122/6 A; 122/7 R

[58] Field of Search ..... 48/67, 77, 73, 63, 76, 48/210, 206; 122/4 D, 5, 6 A, 7, 235 K

[56] References Cited

U.S. PATENT DOCUMENTS

| | | | |
|---|---|---|---|
| 4,098,324 | 7/1978 | Kummel et al. | 122/6 A |
| 4,158,552 | 6/1979 | Blaskowski et al. | 48/210 |
| 4,168,956 | 9/1979 | Blaskowski | 48/210 |
| 4,248,604 | 2/1981 | Woldy et al. | 122/7 R |
| 4,343,627 | 8/1982 | Tonca | 48/210 |
| 4,493,291 | 1/1985 | Zabelka | 122/5 |

FOREIGN PATENT DOCUMENTS

| | | | |
|---|---|---|---|
| WO84/00059 | 1/1984 | PCT Int'l Appl. | 122/7 R |

*Primary Examiner*—Peter Kratz

*Attorney, Agent, or Firm*—Robert L. Olson

[57] ABSTRACT

A gasifier (10) having an associated boiler (26, 32, 42, 48), for converting coal to combustible gas, and also having a desulfurizer (20) downstream of the gasifier. In order to maintain the gas leaving the gasifier and flowing to the desulfurizer above a predetermined temperature, even when operating the unit at reduced loads, a temperature sensing device (56) continuously monitors the gas temperature upstream of the desulfurizer. If the temperature drops below a predetermined value, high temperature boiler water (62) is introduced to the economizer (26) rather than feed water (24), so that less heat is absorbed by the economizer from the gases under these conditions.

1 Claim, 1 Drawing Figure

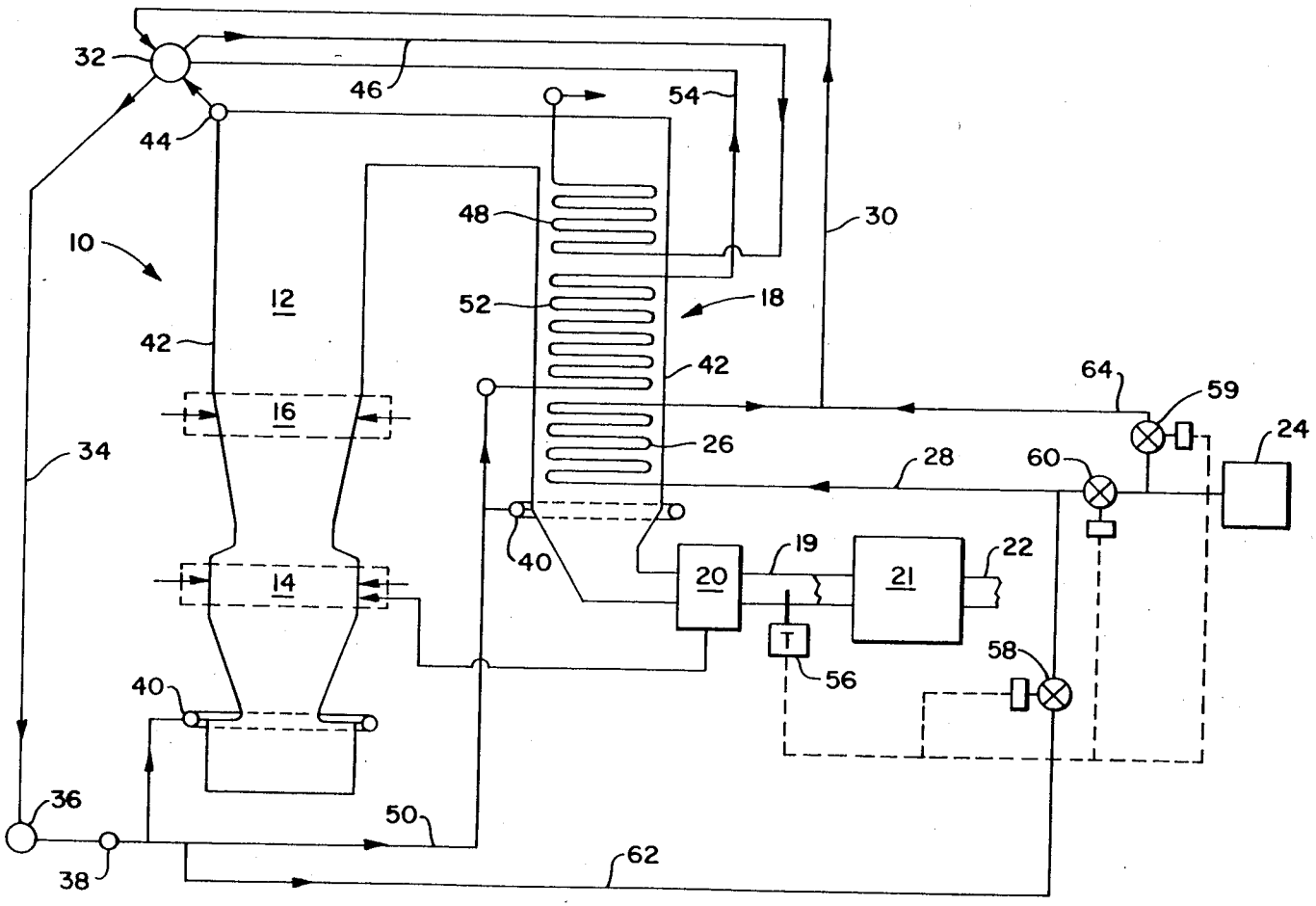
24
59
64
60
58
22
21
28
30
56
19
T
20
18
42
26
54
62
40
48
52
50
46
12
16
14
44
42
40
32
10
34
36
38

GASIFIER WITH ECONOMIZER GAS EXIT TEMPERATURE CONTROL

BACKGROUND OF THE INVENTION

The invention relates to steam generators and in particular to apparatus for elevating economizer gas exit temperature at low load boiler operation. In steam generators associated with a gasifier, which not only generates steam but also a gaseous fuel from the coal fired therein, it is desired to maintain the gas exiting from the economizer at a relatively high temperature. This is particularly true when a desulfurizing system is located downstream of the gasifier, and the efficiency of the desulfurizer is dependent on the temperature of the gas passing therethrough.

SUMMARY OF THE INVENTION

In accordance with the invention, the heat absorbed by the economizer of a steam generator associated with gasifier using a coal as a fuel is decreased as the unit goes down in load. This is accomplished by continuously monitoring the temperature of the gas exiting from the economizer and flowing to a desulfurizing unit, and increasing flow of water from the water wall inlet to the economizer and decreasing flow of feed water thereto, when the gas temperature decreases, and vice-versa.

BRIEF DESCRIPTION OF THE DRAWING

The FIGURE is a schematic illustration of a coal gasifier unit incorporating the invention.

DESCRIPTION OF THE PREFERRED EMBODIMENT

A coal gasifier 10 is shown as having a reactor 12 in which two-stage gasification takes place. In the first stage 14, a portion of the total coal flow is introduced into the reactor along with most of the oxidant, generating a high temperature gas. In the second stage 16, the remaining portion of the total coal is introduced. Under the overall substoichiometric or reducing conditions in the second stage, the volatiles are driven off from the coal, injected into the second stage and a portion of the fixed carbon is gasified by reaction with the carbon dioxide and water vapor. The resultant high temperature combustible gas along with any ungasified carbon and ash flow upwardly through the reactor then down through the rear path 18, giving up heat to the various heat exchange members as it flows therethrough.

After traversing all of the heat exchange surfaces in the steam generator, the low BTU gas flows through duct 19 to a dust collector system 20, which collects any ungasified carbon and ash for recycle back to the first stage of the gasifier. Then the gas passes to a desulfurizing unit 21, where the sulfur is removed from the gas. The sulfur-free gas then leaves unit 21 through duct 22 to flow to its ultimate point of use, for example to be used as the fuel in another steam generator, or to be burned and used for driving a gas turbine. In order for the desulfurizing unit 21 to operate most efficiently, it is desirable to have the gases entering at a relatively high temperature, for example 700 F. or higher. Thus the boiler associated with the gasifier 10 is originally designed such that when operating at full load the gas is exiting the unit through duct 19 at about 700 F.

The boiler or steam generator associated with the gasifier 10 includes a feed water heater 24, which supplies the economizer 26 with water through line 28. The water exiting the economizer flows through line 30 to the steam-water separating drum 32. Water flows from drum 32 through a downcomer 34 to a lower supply header 36. Water is forced by means of pump 38 to inlet heater 40, which supplies water to all of the tubes 42 lining the walls of the reactor 12 and rear pass 18. A steam and water mixture exits the wall tubes 42 by way of header 44 and flows back to the drum 32 where the water is separated out, and flows back to the downcomer 34. The steam flows through line 46 to the superheater 48, and then exits to its ultimate point of use, for example to a steam turbine.

Water also flows from pump 38 through line 50 to a steam generating heat exchange member 52 located in the rear pass upstream of the economizer 26. The steam and water mixture exiting heat exchanger 52 flows through line 54 back to the drum 32 where the steam and water are separated.

As mentioned above when the unit is operated at some load below full load, the temperature of the gases flowing to the desulfurizer decreases, and as the load continues to decrease, so does the temperature of the gases. Since it is desired, for the sake of efficiency of the desulfurizer, to have the gases entering the desulfurizer at a predetermined minimum (for example 700 F.) or as close thereto as possible, apparatus is provided to ensure such operation. A temperature sensing device 56 continuously monitors the temperature of the gases leaving the economizer 26 flowing to the desulfurizer 20. When this temperature drops below a predetermined minimum, such as 700 F., the temperature controller opens valve 58 and 59 and closes valve 60. The valve 58 is located in line 62, which extends from the pump 38 to the economizer inlet line 28. Thus when the temperature of the gases in duct 19 decrease, relatively hot water flows from the water wall inlet to the economizer 26, while feed water from heater 24 is bypassed around the economizer through line 64. The feed water may be on the order of 475 F., and the water wall inlet temperature at 600–650 F. for a unit operating at 2400 psi. Thus much less heat is absorbed from the gases in the economizer when it is supplied with water wall inlet water rather than feed water. When the temperature of gases in duct 19 again comes up to the predetermined desired temperature and is sensed by the temperature controller, valve 58 and 59 are closed and the valve 60 is opened.

We claim:

1. A gasifier including a reactor, means for introducing coal and oxidant to a first zone in the reactor in such a ratio as to be burned under near stoichiometric conditions, means for introducing coal to a second zone in the reactor so as to be burned under reducing substoichiometric conditions, a rear pass connected to the reactor through which the hot gases flow after traversing the reactor a desulfurizing unit connected to the rear pass by a duct through which the gases flow, a feed water heater, an economizer located in the rear pass, a steam-water drum, steam generating tubes having inlets and outlets lining the walls of the reactor, first pipe means connecting the feed water heater to the economizer, said first pipe means having a first valve therein, downcomer means fluidly connecting the steam-water drum to the inlets of the steam generating tubes, second pipe means connecting the downcomer means to the economizer, said second pipe means having a second valve therein, third pipe means connecting the economizer to the steam-water drum, control means for measuring the temperature of the gases in the duct, said control means being connected to the first and second valves such that when the temperature sensed in the duct is above a predetermined temperature the first valve is opened and the second valve is closed, and when the temperature sensed in the first duct is below the predetermined temperature the first valve is closed and the second valve is opened.

* * * * *